US008154505B2

(12) United States Patent
Lin et al.

(10) Patent No.: US 8,154,505 B2
(45) Date of Patent: Apr. 10, 2012

(54) BACKLIGHT MODULE HAVING A CHAMBERED CIRCUIT BOARD

(75) Inventors: Wen-Tsung Lin, Tainan (TW); Tz-Lung Su, Tainan (TW); Shih-Ming Chen, Tainan (TW)

(73) Assignee: Chimei Innolux Corporation (TW)

( * ) Notice: Subject to any disclaimer, the term of this patent is extended or adjusted under 35 U.S.C. 154(b) by 1023 days.

(21) Appl. No.: 11/656,209

(22) Filed: Jan. 22, 2007

(65) Prior Publication Data

US 2007/0188115 A1 Aug. 16, 2007

(30) Foreign Application Priority Data

Jan. 23, 2006 (TW) ..... 95102517 A

(51) Int. Cl.
*G09G 3/36* (2006.01)

(52) U.S. Cl. ..... 345/102; 315/312

(58) Field of Classification Search ..... 345/102; 315/312, 169.1–169.4
See application file for complete search history.

(56) References Cited

U.S. PATENT DOCUMENTS

| | | | | |
|---|---|---|---|---|
| 6,661,181 | B2 * | 12/2003 | Shin | 315/169.4 |
| 6,977,641 | B2 * | 12/2005 | Fan et al. | 345/102 |
| 2005/0122739 | A1 * | 6/2005 | Huang et al. | 362/608 |
| 2006/0001386 | A1 * | 1/2006 | Kim et al. | 315/312 |

FOREIGN PATENT DOCUMENTS

| | | |
|---|---|---|
| TW | 594223 | 6/2004 |
| TW | 228616 | 3/2005 |
| TW | 275426 | 9/2005 |
| WO | WO2005109966 | 11/2005 |

* cited by examiner

*Primary Examiner* — Alexander Eisen
*Assistant Examiner* — Robin Mishler
(74) *Attorney, Agent, or Firm* — Trop Pruner & Hu, P.C.

(57) ABSTRACT

The backlight module includes a first lamp, a second lamp, a circuit board and a driving circuit board. The circuit board includes chambers to be connected to the first lamp and the second lamp, and capacitors to stabilize a voltage across two ends of each of the first lamp and the second lamp. The driving circuit board includes an inverter for driving the first lamp and the second lamp via the circuit board.

18 Claims, 13 Drawing Sheets

BACKLIGHT MODULE HAVING A CHAMBERED CIRCUIT BOARD

CROSS REFERENCE TO RELATED APPLICATION

This claims priority under 35 U.S.C. §119 of Taiwan Application No. 95102517, filed Jan. 23, 2006.

TECHNICAL FIELD

The present invention relates generally to a backlight module, and more particularly to a backlight module having a chambered circuit board.

BACKGROUND

Flat panel displays such as liquid crystal displays (LCDs), organic light-emitting displays (OLEDs), and plasma display panels (PDPs) are now widely available to consumers. Some flat panel displays include a backlight module. The backlight module provides a light source to illuminate the flat panel for displaying images.

FIG. 1 is a top view of a conventional backlight module 10. In this view of the conventional backlight module 10, a module casing 110, lamps 120, a backpanel 160, lamp wires 170, and high-voltage power lines 180 can be observed. In a bottom view of the conventional backlight module 10, which is illustrated in FIG. 2, a driving circuit board 150, and connectors 185 are shown.

The lamps 120, the driving circuit board 150, the backpanel 160, the lamp wires 170, the high-voltage power lines 180, and the connectors 185 are all disposed in the module casing 110. The connectors 185 are electrically connected to the lamp wires 170 of the lamps 120 through the high-voltage power lines 180. The lamps 120 are disposed on the backpanel 160, and the driving circuit board 150 is disposed under the backpanel 160.

As is shown in FIG. 2, the driving circuit board 150 includes connectors 154, capacitors 134, a printed circuit board 156, and an inverter 152. The connectors 154, the capacitors 134, and the inverter 152 are disposed on the printed circuit board 156, and the connectors 154 are coupled to the connectors 185 such that the inverter 152 drives the lamps 120 through the capacitors 134 and the connectors 154.

The conventional backlight module 10 has a number of connectors 154. Because of the number of the connectors 154, the connectors 185 and the high-voltage power lines 180 have to correspond to the number of the lamps 120. But the prices of the connectors 154, the connectors 185, and the high-voltage power lines 180 are not low. Thus, the manufacturing cost of the conventional backlight module cannot be reduced effectively.

Additionally, the board material for the printed circuit board 156 usually has the rectangular shape. Some of the board material cannot be utilized after the connectors 154, the capacitors 134, and the inverter 152 are disposed on the printed circuit board 156, thereby wasting the resource.

Thus, there is a need for a backlight module that can be manufactured at a reduced cost and that wastes less material.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

In accordance with some embodiments, a backlight module having a reduced number of connectors and high-voltage power lines (as compared to the conventional backlight module 10) is provided. Furthermore, in accordance with some embodiments, manufacturing costs can be reduced by using different circuit boards for the inverter and for the capacitors that are coupled to the lamps.

Figure 1:
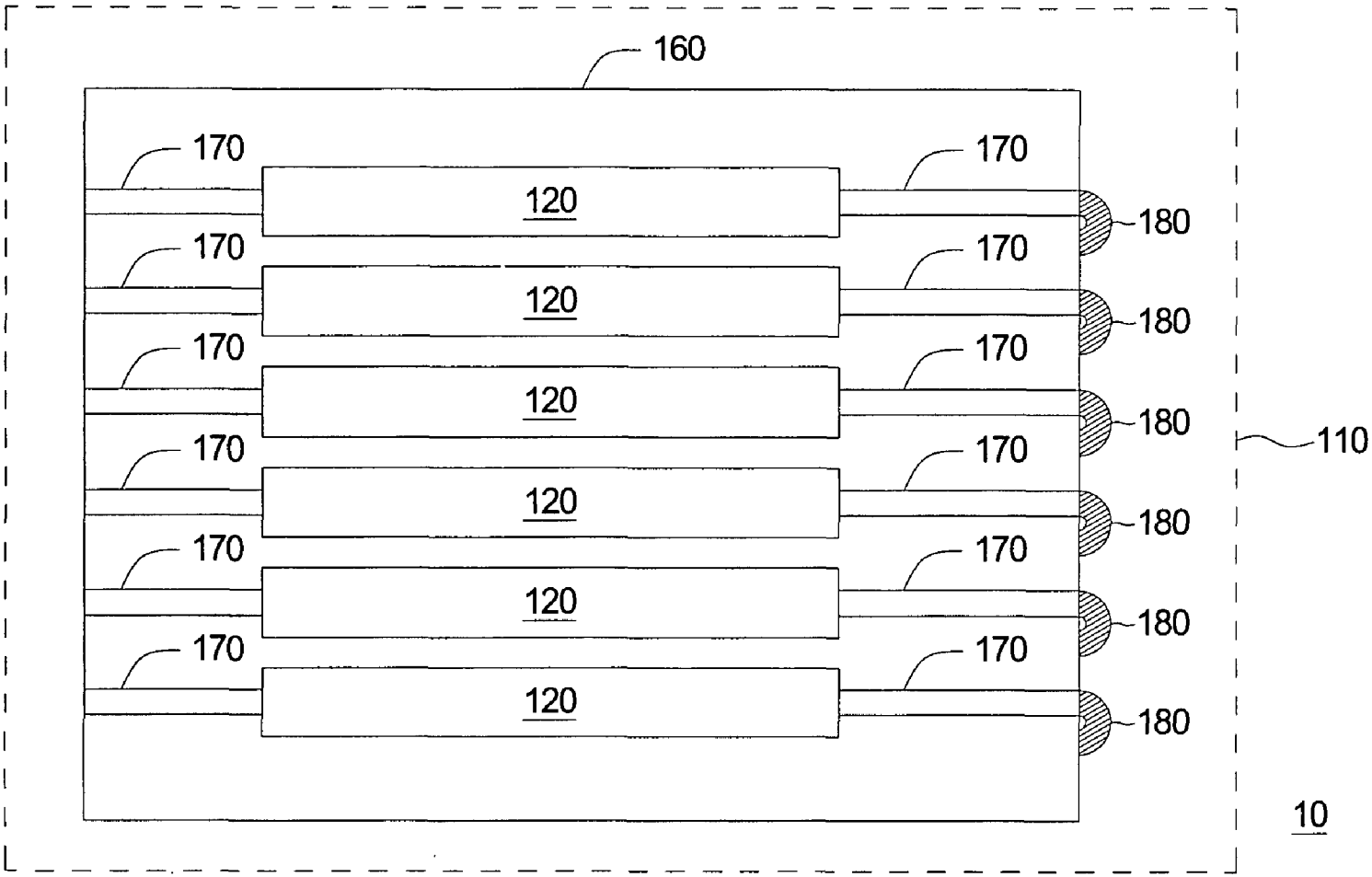
FIG. 1 (Prior Art)
FIG. 1 is a top view showing a conventional backlight module.
Figure 2:
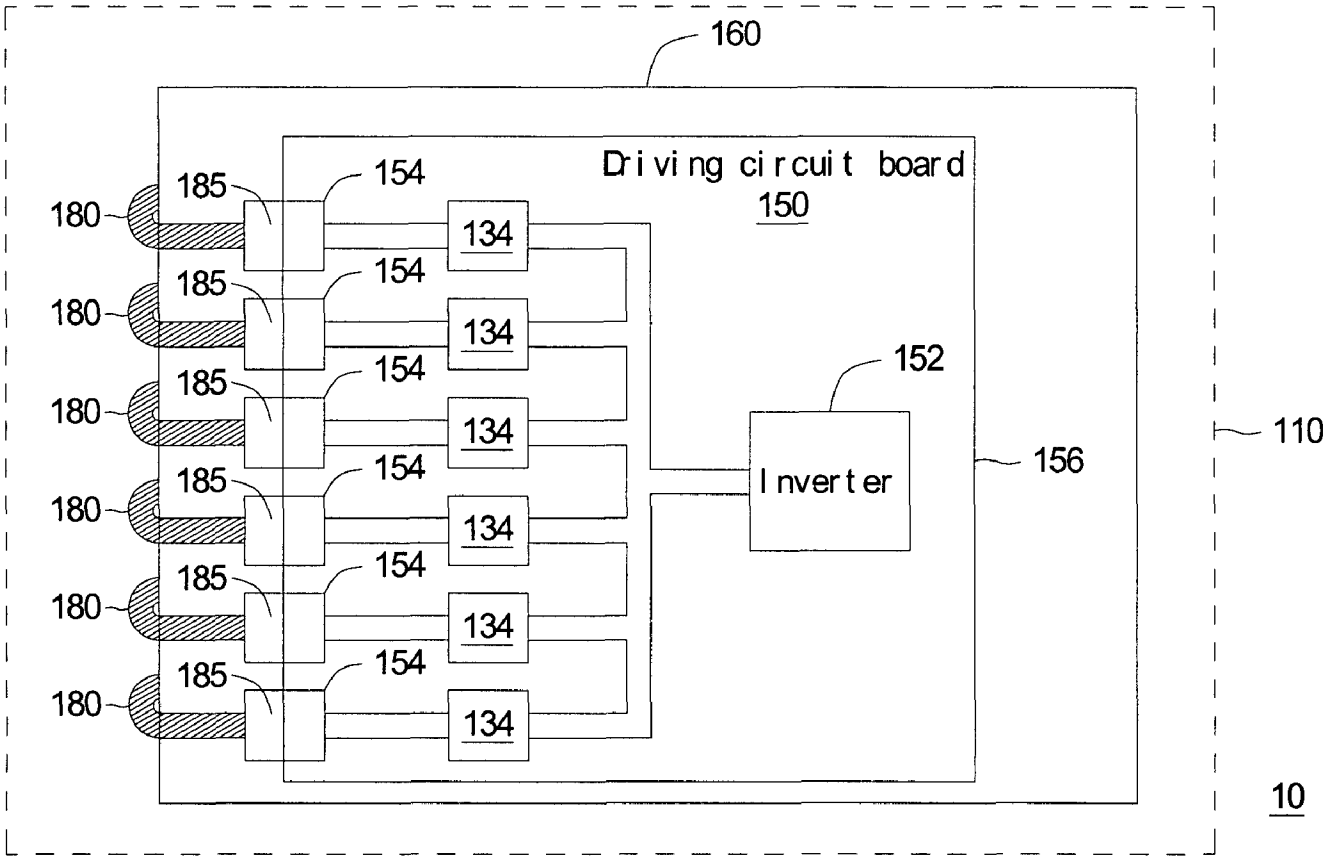
FIG. 2 (Prior Art)
FIG. 2 is a bottom view showing the conventional backlight module.
Figure 3:
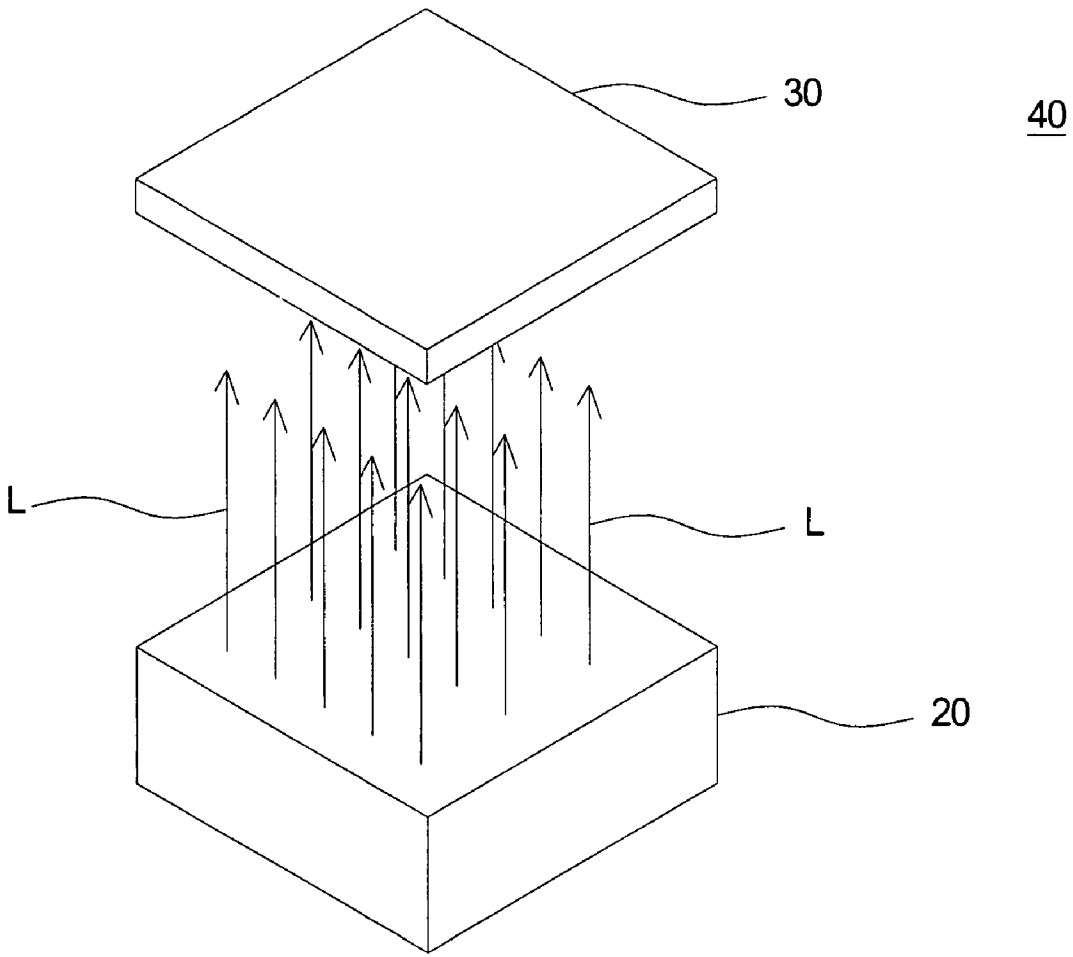
FIG. 3 is an exploded perspective view showing a flat panel display.

FIG. 3 shows an exploded view of a flat panel display 40. The flat panel display 40 includes a display panel 30 and a backlight module 20 for generating light L to make the display panel 30 display the frame luminance.

Figure 4:
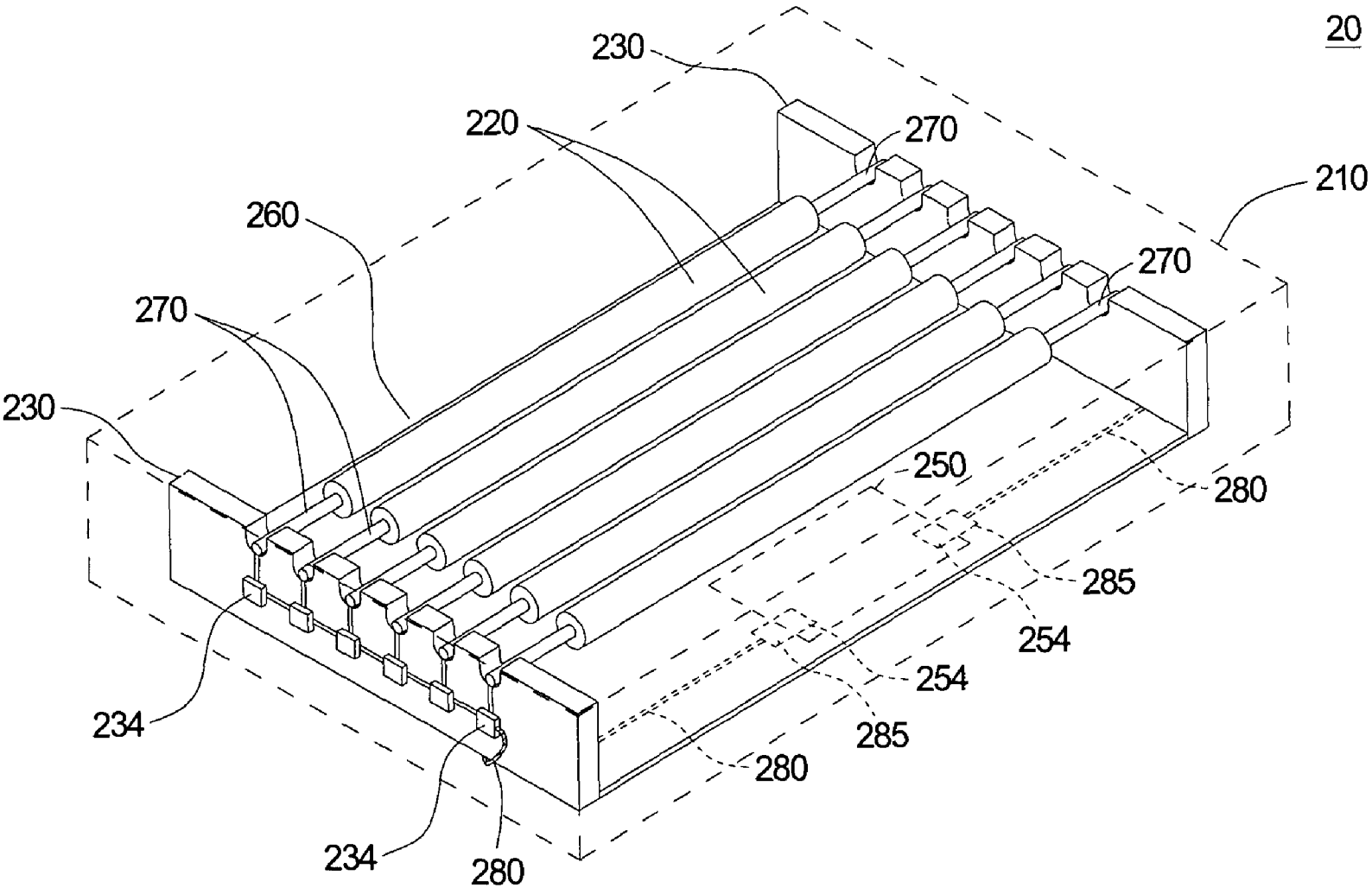
FIG. 4 is a pictorial view showing the interior of a backlight module according to an embodiment of the invention.

The backlight module 20, which is shown in FIG. 4, includes a module casing 210, lamps 220 (six lamps in this example), two circuit boards 230, a driving circuit board 250, a backpanel 260 and lamp wires 270. The lamps 220, the circuit boards 230, the driving circuit board 250, the backpanel 260, and the lamp wires 270 are disposed in the module casing 210. Although an embodiment is described as having two circuit boards 230 with capacitors 234 and six lamps 220, it should be noted that the scope of invention is not limited thereto. That is, embodiments of the backlight module may have any number of circuit boards 230 and any other number of lamps 220.

Figure 5:
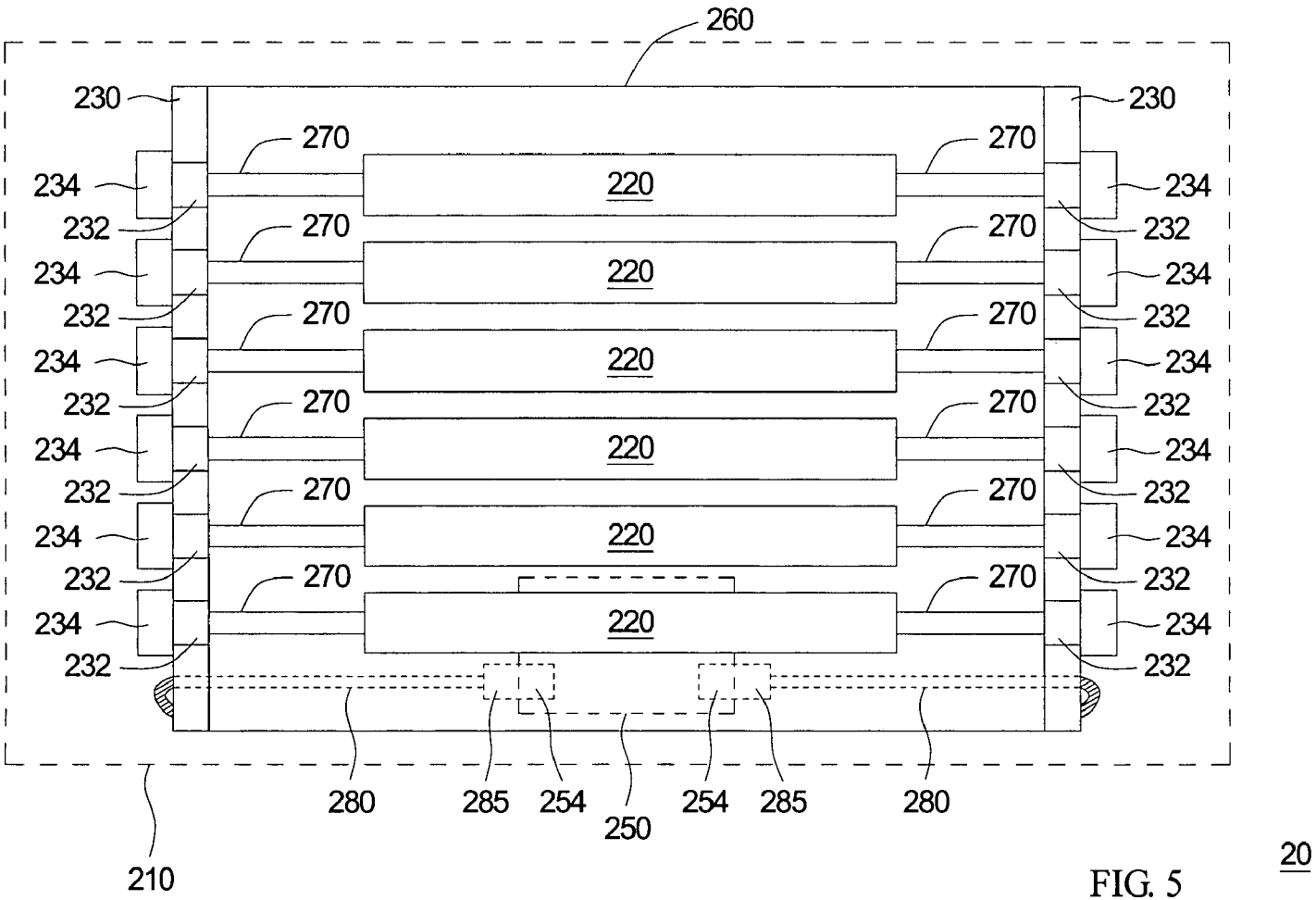
FIG. 5 is a top plan view showing the backlight module according to the embodiment of FIG. 4.

The circuit boards 230 each have six sides and are made of a printed circuit board as one example. As is shown in FIGS. 4 and 5, the two circuit boards 230 are disposed above the backpanel 260 and are perpendicular to the backpanel 260 such that one side of each circuit board 230 faces toward the other circuit board. The lamps 220 are disposed above the backpanel 260 and are perpendicular to the circuit boards 230. The circuit boards 230 are coupled to the lamps 220 through the lamp wires 270. The lamps 220 may be cold cathode fluorescent lamps (CCFL) as one example.

Figure 6:
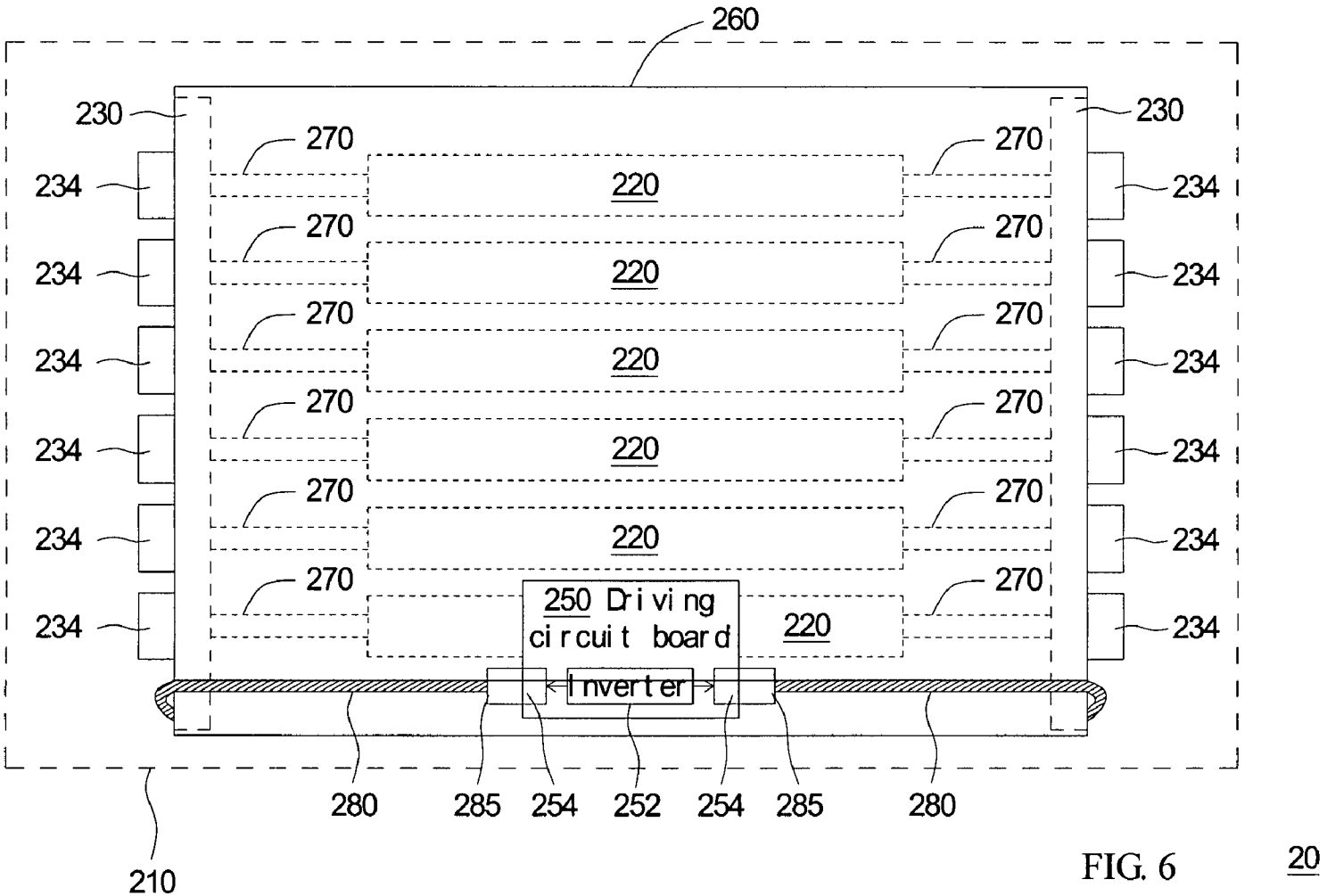
FIG. 6 is a bottom plan view showing the backlight module according to the embodiment of FIG. 4.

As is shown in FIG. 6, the driving circuit board 250 is horizontally disposed under the backpanel 260. The driving circuit board 250 includes an inverter 252 and connectors 254. The inverter 252 is coupled to connectors 285 of the circuit boards 230 through the connectors 254, and drives the lamps 220 through capacitors 234 and the lamp wires 270. Thus, a single inverter can drive multiple lamps.

The circuit board 230 shown in FIGS. 4 through 7 has chambers disposed at one side; the chambers enable connection to the lamps 220. In some embodiments the chambers may have a U-type structure 232, although embodiments are not so limited. The U-type structure 232 can be bonded to one end of the lamp wire 270. When the lamp wire 270 is bonded to the U-type structure 232 to electrically connect the lamp wire 270 to the U-type structure 232, the lamp 220 also can be positioned in the module casing 210.

Figure 7:
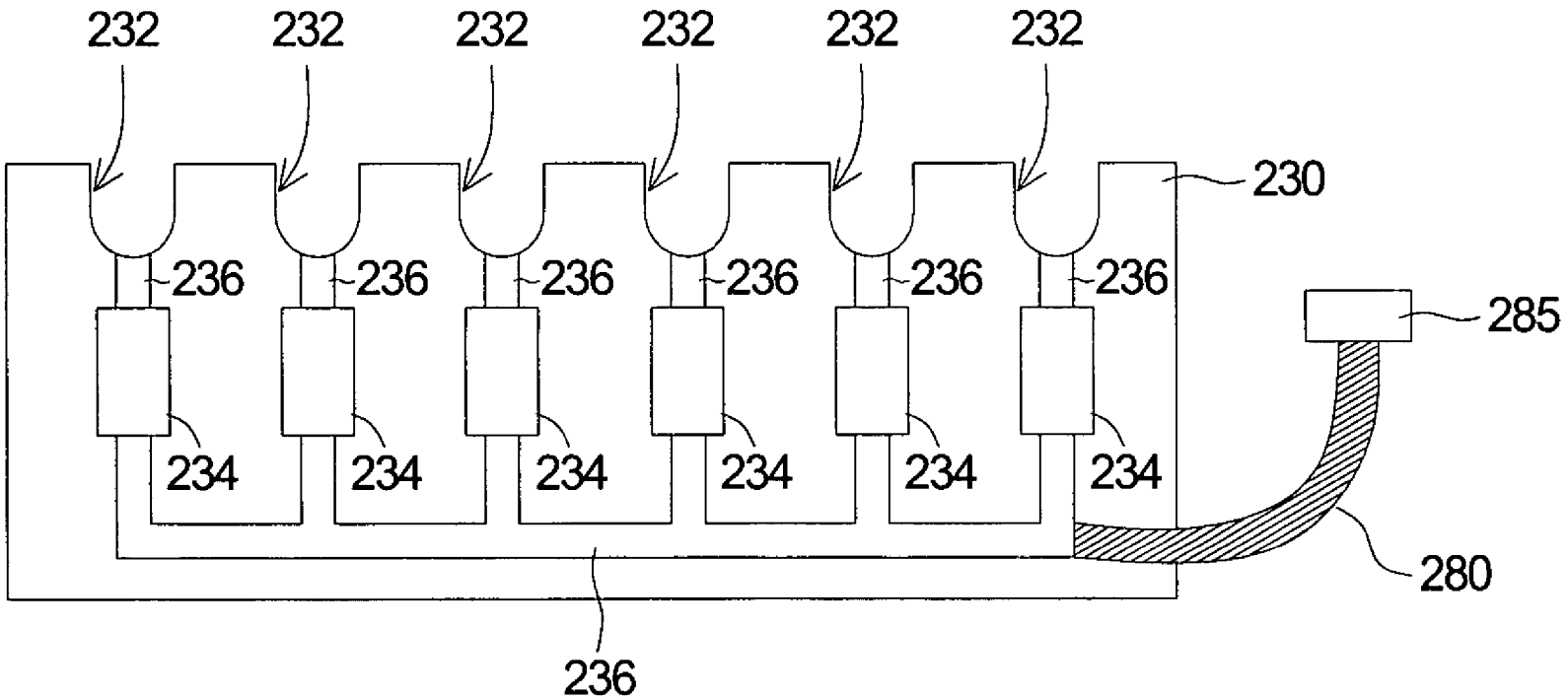
FIG. 7 is a schematic side view showing a circuit board.

Referring to FIG. 7, the circuit board 230 also includes the capacitors 234, power traces 236, a high-voltage power line 280, and one connector 285. The capacitors 234 of the circuit board 230 may stabilize the voltage across the first and second ends of each lamp 220. The capacitor 234 may be a surface mount device (SMD), a dual in-line package (DIP) or a multi-layer ceramic chip capacitor (MLCC) as a few examples. The capacitors 234 can be bonded onto the circuit board 230. For example, the capacitors 234 can be bonded to the upper surface of the circuit board 230 or to the upper and lower surfaces of the circuit board 230. The circuit board 230 is etched to form the power traces 236 after circuit layout. Thus, first ends of the capacitors 234 are respectively coupled to the U-type structures 232 through the power traces 236 and second ends of the capacitors 234 are respectively coupled to a first end of the high-voltage power line 280 through the power traces 236. A second end of the high-voltage power line 280 is coupled to the connector 285. The connector 285 of the circuit board 230 is coupled to the connector 254 of the driving circuit board 250 (see, e.g. FIG. 6) such that the high voltage provided by the inverter 252 is outputted to the lamps 220. Thus, the lamps 220 generate light L for the display panel 30 via the high-voltage power line 280 and the capacitors 234 of the circuit board 230.

In other words, the inverter 252 can be coupled to the multiple lamps 220 to drive the lamps 220 using the connectors 285 and 254 and one high-voltage power line 280. This can effectively reduce the manufacturing cost of the flat panel display 40. Furthermore, the power traces 236 etched in the circuit board 230 are coupled to one high-voltage power line 280. Thus, the inverter 252 can be electrically coupled to multiple capacitors 234 to drive multiple lamps 220 through only one high-voltage power line 280. As compared to the conventional backlight module, the number of the high-voltage power lines is reduced. Moreover, because the number of the high-voltage power lines is reduced, it is possible to prevent the high-voltage power line from detachment under forces and to prevent insulation damage. Furthermore, the number of the connectors 254, 285 can be reduced as compared to conventional modules. Because multiple lamps 220 can be driven through only one high-voltage power line 280, only one connector couples the capacitors to the inverter. Thus, the number of the connectors in the backlight module can be reduced, and the manufacturing cost of the display can be effectively reduced.

Figure 8:
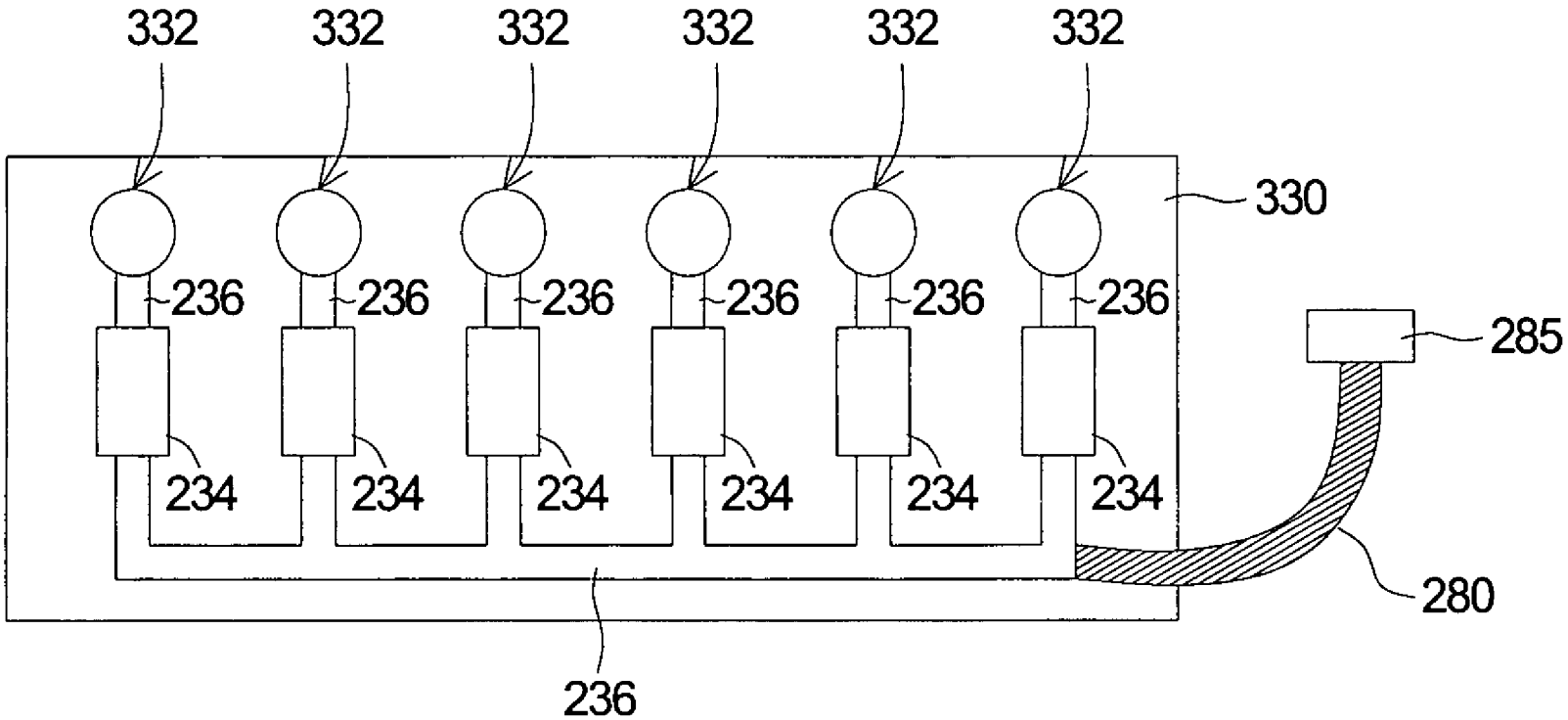
FIG. 8 is another side view schematic illustration showing the circuit board.

In other embodiments of the circuit board, the chamber may be other than U-type, with the remainder of the circuit being the same or similar. For instance, FIG. 8 shows another schematic illustration of the circuit board. In this Figure, the chamber is shown having a circular structure 332 that is coupled to the lamp wire 270.

As is shown in FIGS. 7 and 8, the material of the circuit board can be reduced. Because the capacitors are bonded to the circuit boards that are perpendicular to the the circuit board can be avoided. The driving circuit board is provided only for the purpose of arranging the inverter circuits.

FIGS. 9 to 13 illustrate schematic views of several ways in which the lamps 220 can be coupled to capacitors 234.

Figure 9:
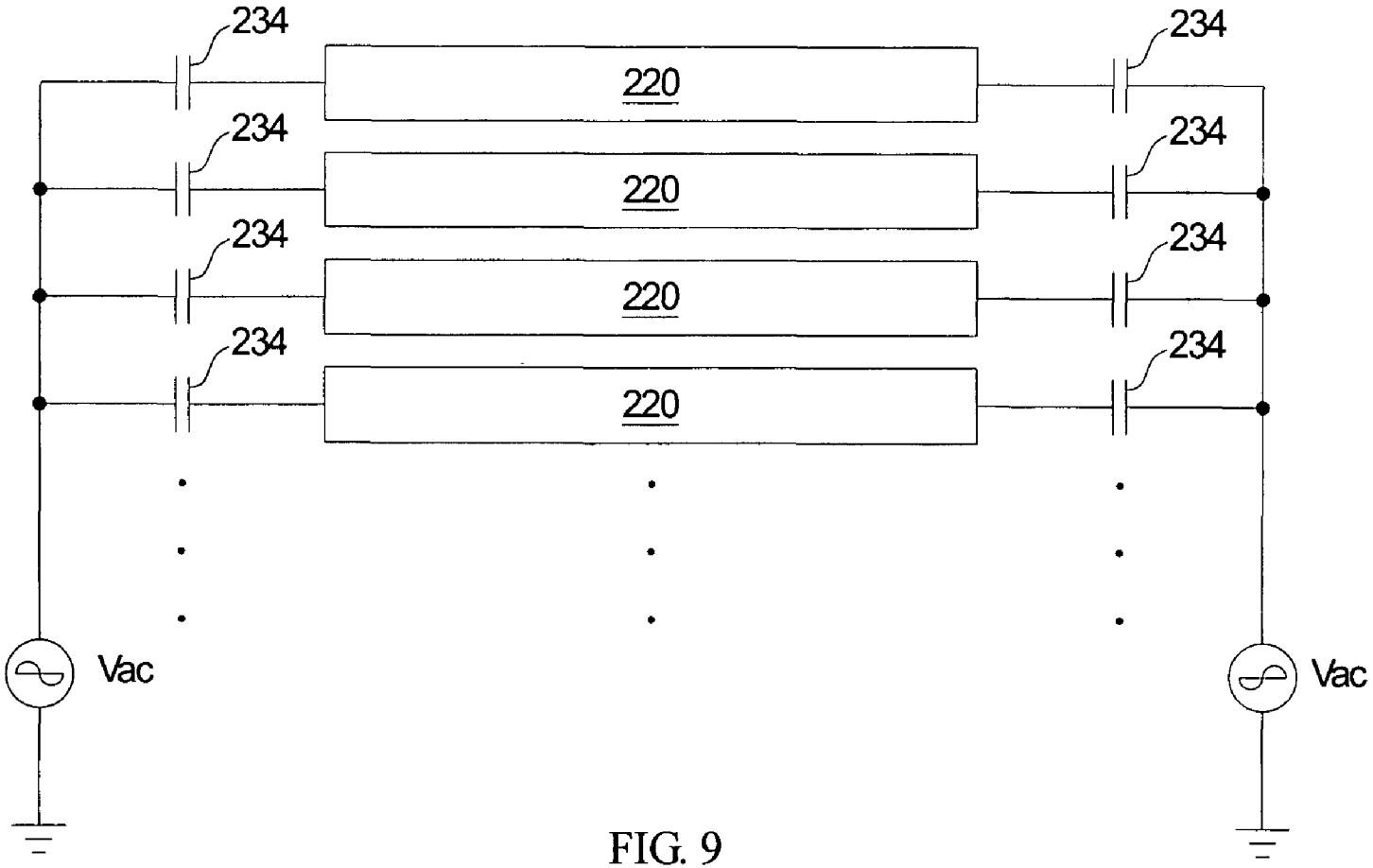
FIGS. 9 to 13 are schematic illustrations showing several embodiments of circuits for backlight modules.

Referring to FIG. 9, an embodiment of a circuit of the backlight module is shown. The lamps 220 of FIG. 9 are linear lamps, the second terminals of the capacitors 234 are coupled to respective first and second ends of the linear lamps, and the first terminals of the capacitors 234 are coupled to the inverter 252 such that the power voltage Vac generated by the single inverter 252 can drive the multiple lamps 220 through the capacitors 234.

Figure 10:
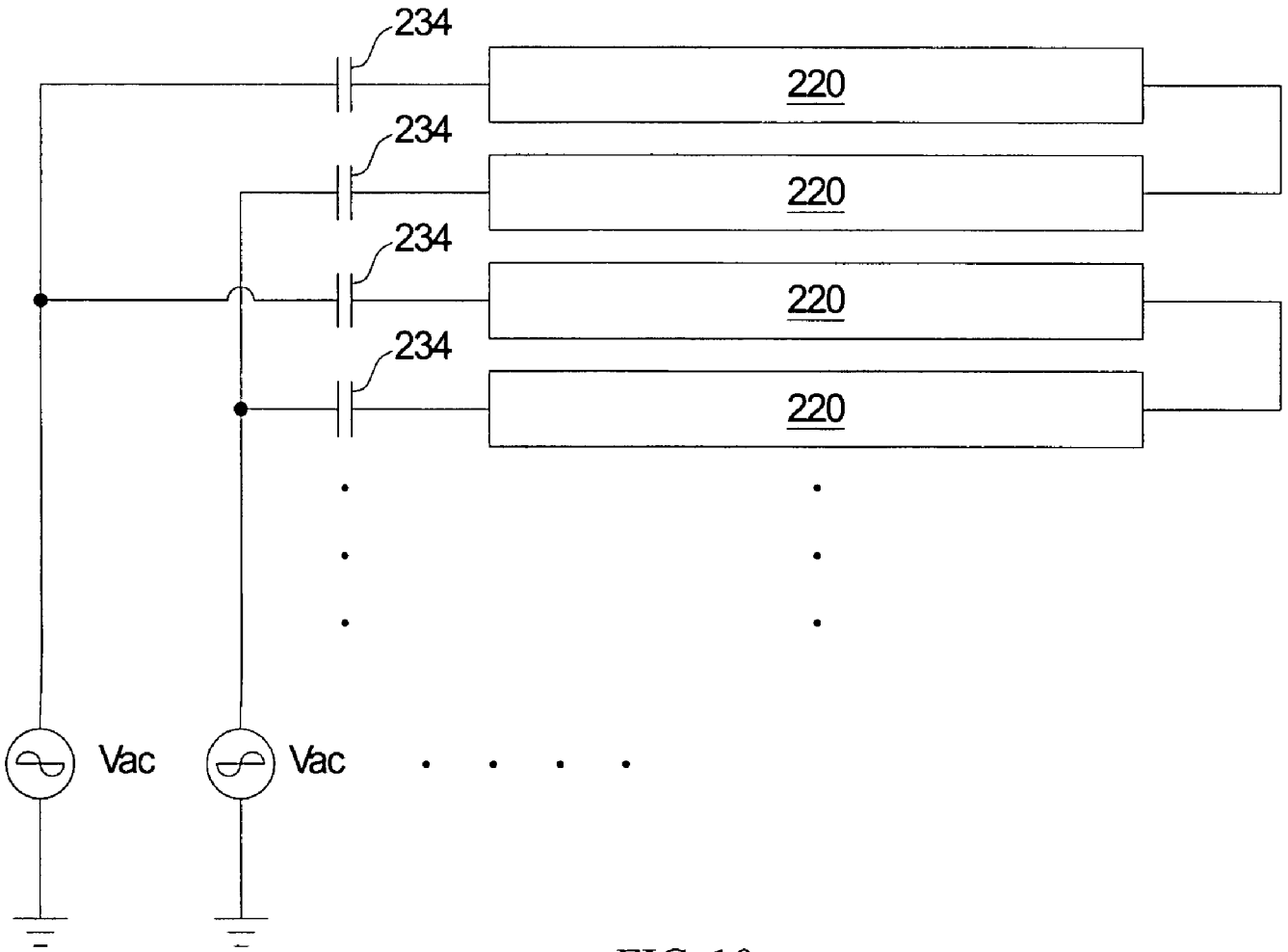

As shown in FIG. 10 the lamps 220 are linear lamps; the first ends of two adjacent linear lamps are coupled to each other to form a quasi-U lamp. The second ends of the lamps 220 are coupled to the second terminals of the capacitors 234, and the first terminals of the capacitors 234 are coupled to the inverter 252 such that the power voltage Vac generated by the single inverter 252 can drive the multiple lamps 220 through the capacitors 234.

Figure 11:
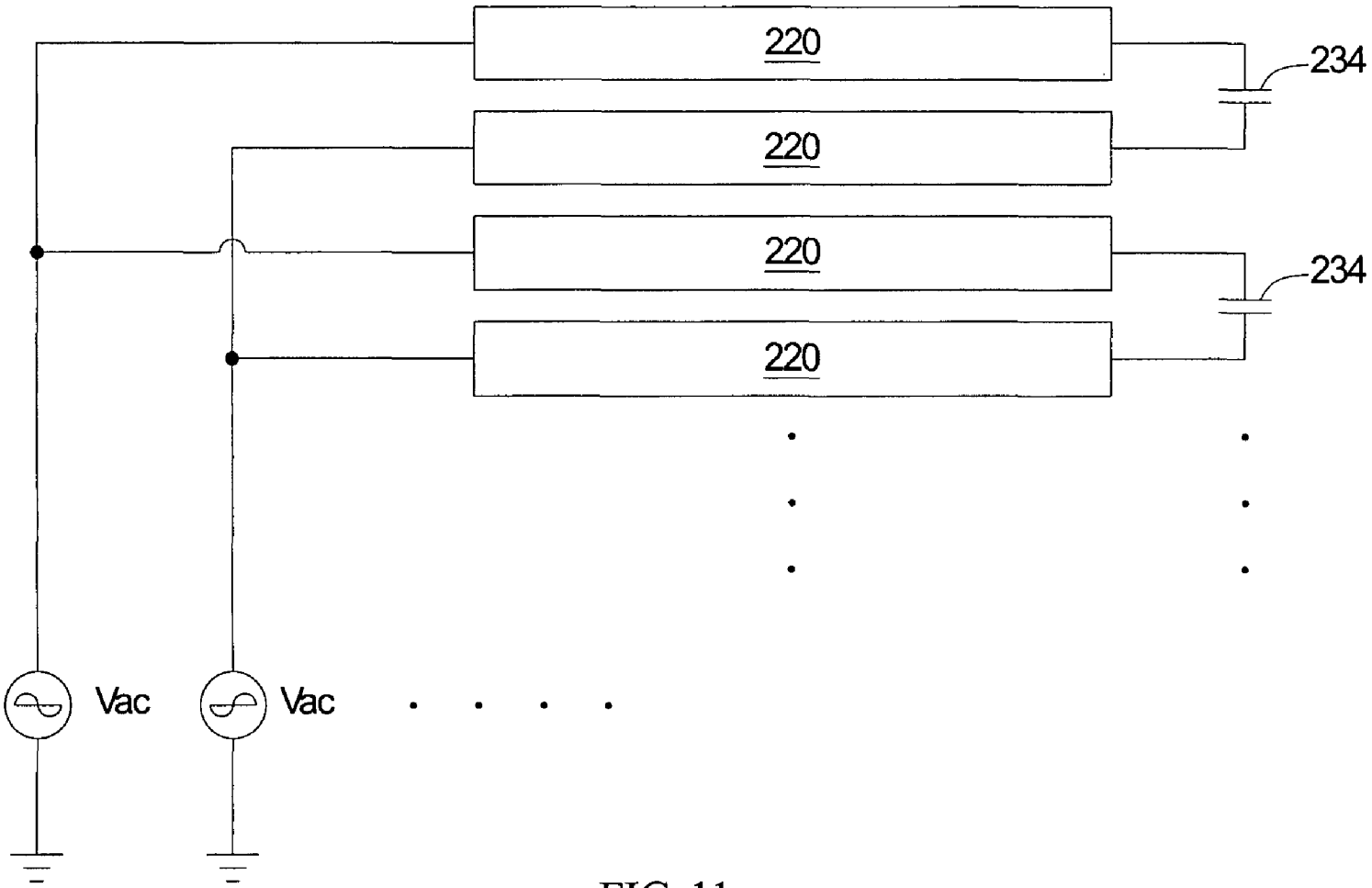

In the embodiment shown in FIG. 11 the lamps 220 are linear lamps as well. The first ends of two adjacent lamps 220 are coupled to the first terminal and the second terminal of the capacitor 234 respectively whereas, the second ends of the lamps 220 are coupled to the inverter 252 such that the power voltage Vac generated by the single inverter 252 can drive the multiple lamps 220 through the capacitors 234.

Figure 12:
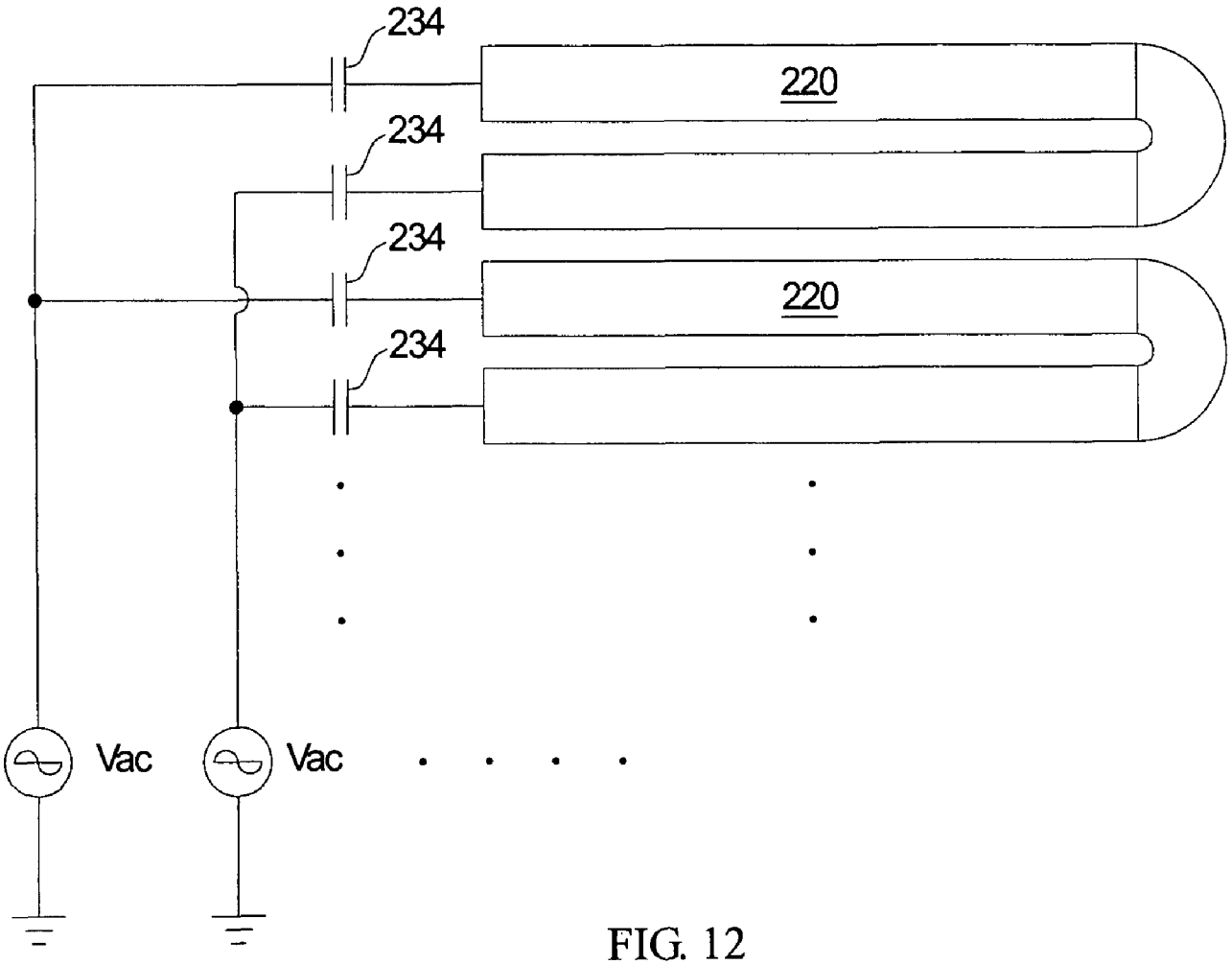

The lamp 220 shown in FIG. 12 is a C-type lamp. Each end of the C-type lamp is coupled to the second terminal of a respective capacitor 234. The first terminals of the capacitors 234 are coupled to the inverter 252 such that the power voltage Vac generated by the single inverter 252 can drive the multiple lamps 220 through the capacitors 234.

Figure 13:
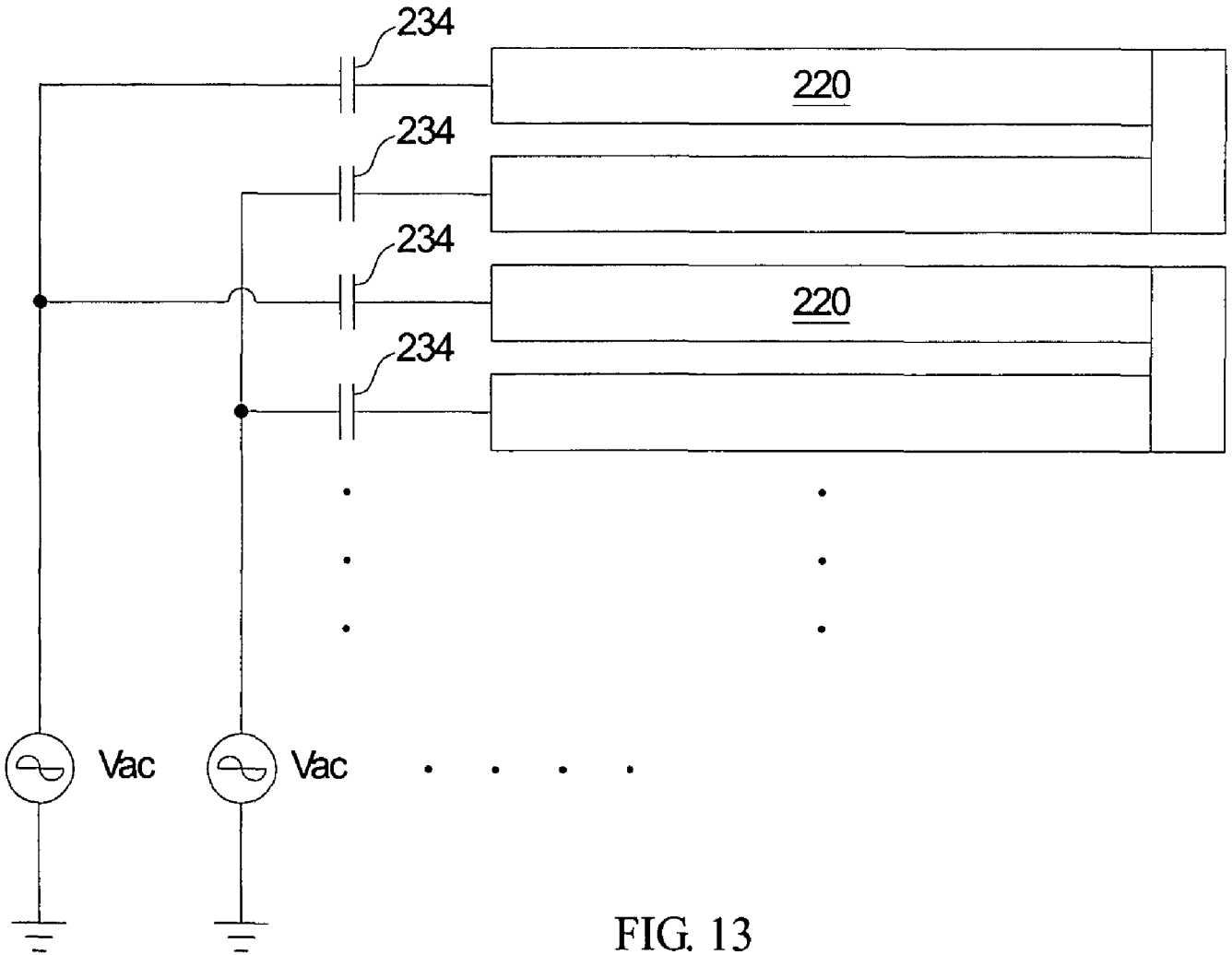

Yet another embodiment is shown in FIG. 13. The lamp 220 of FIG. 13 is a U-type lamp. Each end of the U-type lamp is coupled to the second terminal of a respective capacitors 234, and the first terminal of the capacitor 234 is coupled to the inverter 252 such that the power voltage Vac generated by the single inverter 252 can drive the multiple lamps 220 through the capacitors 234.

It should be noted, however, that the lamp 220 is not restricted to the linear lamp, C-type lamp, or U-type lamp. Instead, it is also possible to use the L-type lamp, the W-type lamp, the circular lamp, or a lamp with any other shape. Furthermore, when at least one dual-panel or at least two single-panels are used, high-voltage capacitors disposed at two sides of the dual-panel or the two single-panels can drive the U-type lamp or the C-type lamps.

While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A backlight module, comprising:

a backpanel;

a first lamp and a second lamp disposed above the backpanel, the first and second lamps each having a first end and a second end;

a first connecting circuit board disposed vertically relative to the backpanel, the first connecting circuit board having at least two chambers and at least two capacitors, one of the at least two chambers connected to the first lamp and another of the at least two chambers connected to the second lamp, and the at least two capacitors disposed on the first connecting circuit board to stabilize a voltage across the first and second ends of the first lamp and the second lamp; and a driving circuit board disposed horizontally relative to the backpanel and electrically connected to the first connecting circuit board, the driving circuit board having an inverter to drive the first lamp and the second lamp via an electrical connection to the first connecting circuit board;

wherein the at least two capacitors each have a first terminal and a second terminal, the second terminals of the at least two capacitors are respectively coupled to the corresponding at least two chambers, and the electrical connection includes a high voltage lead having a first end connected at the first connection circuit board to the first terminals of the two capacitors and a second end connected at the driving circuit board to the inverter.

2. The backlight module of claim 1, wherein the first connecting circuit board includes a first side and a second side opposite the first side, and wherein the at least two chambers are disposed at the first side, and the first ends of the first and second lamps are respectively bonded to the one of the at least two chambers and the other of the at least two chambers.

3. The backlight module of claim 1, wherein each of the at least two chambers has a U-type structure.

4. The backlight module of claim 1, wherein each of the at least two chambers has a ring-shaped structure.

5. The backlight module of claim 1, wherein the first lamp and the second lamp each have a lamp wire, the lamp wires bonded to the respective one of the at least two chambers and the other of the at least two chambers.

6. The backlight module of claim 1, further comprising a module casing, and wherein the first connecting circuit board and the backpanel are accommodated in the module casing, and wherein the driving circuit is disposed under the backpanel.

7. The backlight module of claim 1, including a second connecting circuit board disposed vertically relative to the backpanel, the first connecting circuit board disposed at the first ends of the first and second lamps and the second connecting circuit board disposed at the second ends of the first and second lamps.

8. The backlight module of claim 1, wherein the second terminals of the at least two capacitors are coupled to the first ends of the first lamp and the second lamp

9. The backlight module of claim 8, wherein the first lamp and the second lamp each have a lamp wire, and the lamp wires are coupled to the second terminals of the at least two capacitors.

10. A flat panel display, comprising:

a display panel; and a backlight module comprising:

a backpanel;

at least one first lamp and a second lamp, each lamp having first and second ends, and each lamp disposed above the backpanel;

a first circuit board disposed vertically relative to the backpanel and having a plurality of chambers and a plurality of capacitors, at least one chamber in the plurality connected to the first lamp and at least one other chamber in the plurality connected to the second lamp, said plurality of capacitors disposed on the first circuit board to stabilize a voltage across the first and second ends of the first lamp and the second lamp; and a second circuit board disposed horizontally relative to the backpanel and electrically connected to the first circuit board, the second circuit board having an inverter to drive the first lamp and the second lamp, via an electrical connection to the first circuit board, to generate luminance for the display panel;

wherein each capacitor in the plurality has a first terminal and a second terminal, the second terminals of each capacitor in the plurality are respectively coupled to the corresponding chambers, the electrical connection includes a high voltage lead extending between the first and second circuit boards, the high voltage lead having a first end connected at the first circuit board to the first terminals of each capacitor in the plurality and a second end connected at the second circuit board to the inverter.

11. The display of claim 10, wherein the plurality of chambers are disposed at one side of the first circuit board, and the first end of the first lamp is bonded to the at least one chamber in the plurality and the first end of the second lamp bonded to the at least one other chamber in said plurality.

12. The display of claim 10, wherein each chamber in the plurality has a U-type structure.

13. The display of claim 10, wherein each chamber in the plurality has a ring-shaped structure.

14. The display of claim 10, wherein the first lamp and the second lamp each have a lamp wire, and each lamp wire bonded to a corresponding chamber.

15. The display of claim 10, further comprising a module casing, wherein the first circuit board and the backpanel are accommodated in the module casing and wherein the second circuit board is disposed under the backpanel.

16. The display of claim 10, wherein the backlight module comprises another first circuit board disposed vertically relative to the backpanel, one first circuit board disposed at the first ends of the first and second lamps, the other first circuit board disposed at the second ends of the first and second lamps.

17. The display of claim 10, wherein the first terminal of each capacitor in the plurality is coupled to the inverter, and the second terminal of each capacitor in the plurality is coupled to the first ends of the first and second lamps.

18. The display of claim 17, wherein the first lamp and the second lamp each have a lamp wire, and each lamp wire is coupled to a corresponding second terminal of the plurality of capacitors.

* * * * *